US007013760B1

(12) United States Patent
Kennison

(10) Patent No.: US 7,013,760 B1
(45) Date of Patent: Mar. 21, 2006

(54) TORQUE REACTION CONTROL JIG

(75) Inventor: Aaron Kennison, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 169 days.

(21) Appl. No.: 10/723,639

(22) Filed: Nov. 26, 2003

(51) Int. Cl.
*B25B 17/00* (2006.01)

(52) U.S. Cl. ..... 81/57.4; 81/57.36

(58) Field of Classification Search ..... 81/57.4, 81/57.3, 57.36, 57.39, 57.22, 54, 57.31
See application file for complete search history.

(56) References Cited

U.S. PATENT DOCUMENTS 2,761,340 A * 9/1956 Harrington ..... 81/54
4,063,475 A * 12/1977 Perkins ..... 81/57.22
4,155,278 A 5/1979 Estok
4,385,533 A * 5/1983 Collins ..... 81/57.39
4,462,282 A 7/1984 Biek
4,485,698 A 12/1984 Adman et al.
4,989,478 A * 2/1991 Trivedi et al. ..... 81/57.36
5,074,170 A * 12/1991 Shirley ..... 81/57.3
6,244,138 B1 * 6/2001 Campbell ..... 81/57.4

OTHER PUBLICATIONS

Atlas Copco Tools—No. 9836 1889 00, Sep. 2003 Catalog, Edition 1, pp. 1-53.

* cited by examiner

*Primary Examiner*—Hadi Shakeri
(74) *Attorney, Agent, or Firm*—Rankin, Hill, Porter & Clark LLP; Vincent Ciamacco

(57) ABSTRACT

A torque reaction control jig that transfers reaction torque from a drive member to a wheel upon tightening of a spindle nut onto a vehicle axle. The jig includes a jig body, an alignment member, and a barrier member. The jig body is secured to the drive member in a non-rotatable fashion. The alignment member includes a pair of stud nests that are each adapted to slidingly receive a wheel stud. The barrier member is secured to the jig body in a location such that the barrier member will engage the wheel stud should the jig be misaligned with the wheel. Engagement between the barrier member and the wheel prevents further tightening of the spindle nut onto the axle until the jig is properly aligned with the wheel.

9 Claims, 3 Drawing Sheets

FIG. 1
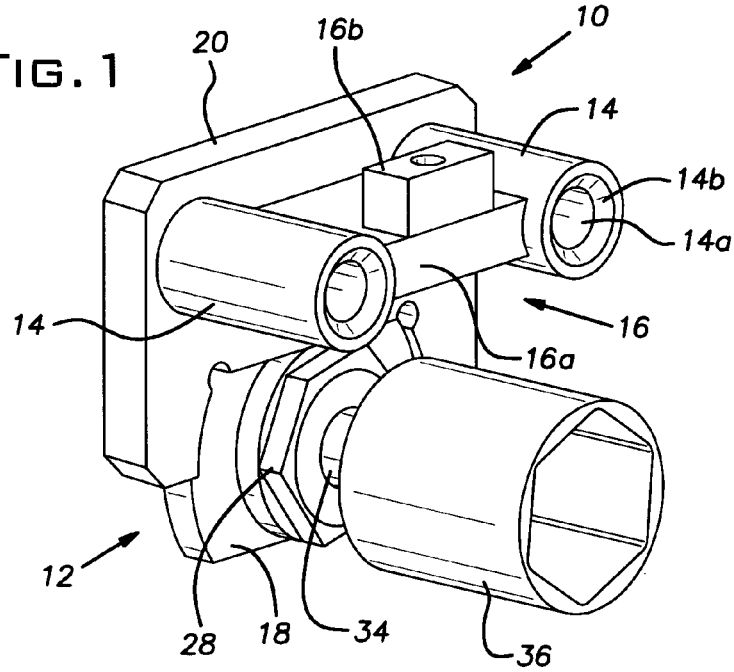
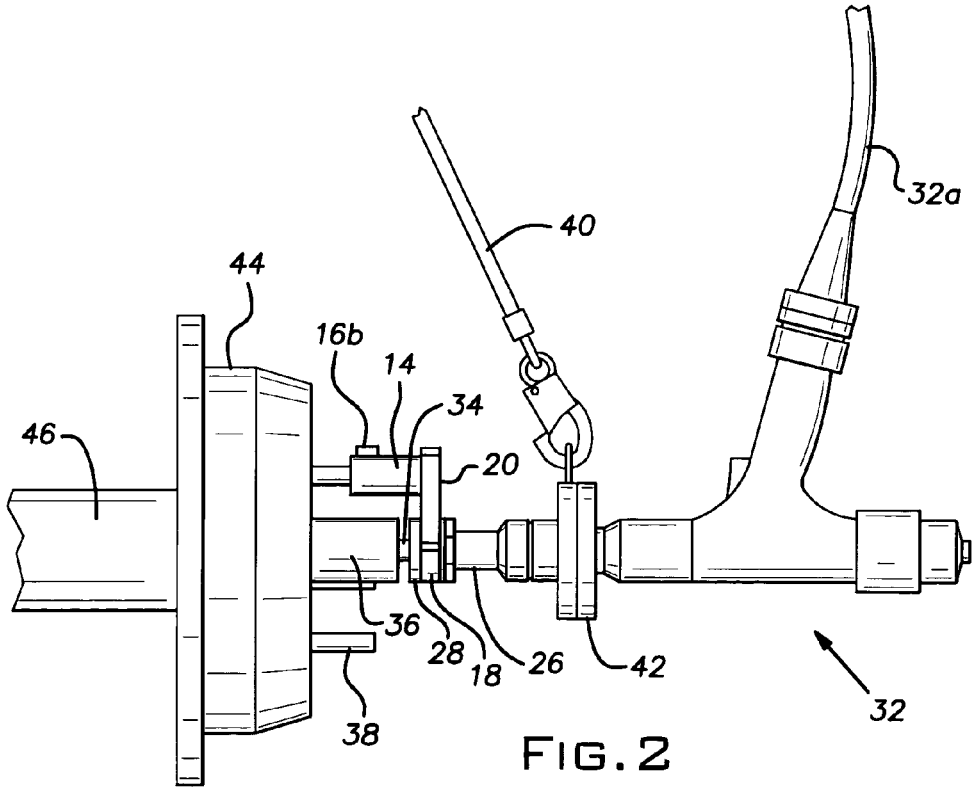
FIG. 2

TORQUE REACTION CONTROL JIG

BACKGROUND OF THE INVENTION

1. Field of the Invention

The present invention is generally directed toward torque reaction jigs or adaptors for hand tools and, more particularly, toward a jig or adaptor for a hand tool that is adapted for tightening of a spindle nut onto a vehicle axle.

2. Description of Related Art

It is known in the art to provide torque reaction control bars on hand tools, such as electric or pneumatic nut runners, to brace and absorb reaction torque that results from tightening of a nut. See, for example, U.S. Pat. Nos. 4,155,278 and 4,462,282. Such torque reaction control bars minimize the reaction torque that is experienced by the operator.

There exist situations wherein such control bars cannot be implemented due to environmental or space considerations, such as when tightening a spindle nut on a stub axle/wheel assembly during assembly of a vehicle. In this situation, the operator may improperly apply the torque reaction control bar, damaging the part and potentially injuring the operator. Accordingly, conventional torque reaction control bars have generally not been adopted in this particular application.

As a result, during tightening of such spindle nuts with an electric or pneumatic nut runner the operator has been required to bear all of the reaction torque, which leads to fatigue and possible safety concerns. Due in part to this problem, it has been common to use a hand-held torque wrench in these situations. Unfortunately, due to the high torque required and the space constraints on an assembly line, such torque wrenches prove to be unwieldy and difficult to use. Therefore, there exists a need in the art for a device and method that facilitates tightening of the spindle nut while minimizing the reaction torque experienced by the operator.

SUMMARY OF THE INVENTION

The present invention is directed toward a torque reaction control jig and associated method that is specially adapted to tightening of a spindle nut on an axle/wheel assembly. The present invention is further directed toward such a torque reaction control jig that is self-aligning, that will be readily apparent to the user when it is not properly positioned on the axle/wheel assembly, and that will absorb and transfer reaction torque to the underlying axle/wheel assembly.

In accordance with the present invention, a torque reaction control jig is adapted to transfer reaction torque from a drive member to a wheel upon tightening of a spindle nut onto an axle. The jig includes a jig body, an alignment member, and a barrier member. The jig body is secured to the drive member in a non-rotatable fashion. The alignment member includes a pair of stud nests that are each adapted to slidingly receive a wheel stud. The barrier member is secured to the jig body and engages the wheel stud should the jig be misaligned with the wheel. Engagement between the barrier member and the wheel prevents further tightening of the spindle nut onto the axle until the alignment of the jig and wheel is corrected.

In further accordance with the present invention, the stud nests are cylindrical in shape, defining a central bore that is surrounded by a beveled annular surface, which assists in inserting the wheel stud into the central bore. The barrier member is disposed between the stud nests, and is positioned to engage the wheel stud if the jig is out of alignment with the wheel.

In accordance with the present invention, a drive socket is able to initially rotatably drive a spindle nut onto an axle regardless of whether the jig is aligned with the wheel. However, prior to development of reaction torque, one of the wheel studs will engage the barrier member to prevent further rotation of the spindle nut onto the axle until the jig alignment is corrected. Accordingly, the present invention alerts the operator to the out-of-alignment condition prior to the development of reaction torque.

BRIEF DESCRIPTION OF THE DRAWINGS

These and further features of the invention will be apparent with reference to the following description and drawings, wherein:

FIG. 1 is a perspective view of a torque reaction control jig according to the present invention;

FIG. 2 is a side elevational view of the torque reaction control jig of FIG. 1 in use with an electric nut runner for tightening a spindle nut onto a wheel assembly;

DETAILED DESCRIPTION OF THE PREFERRED EMBODIMENTS

Figure 3:
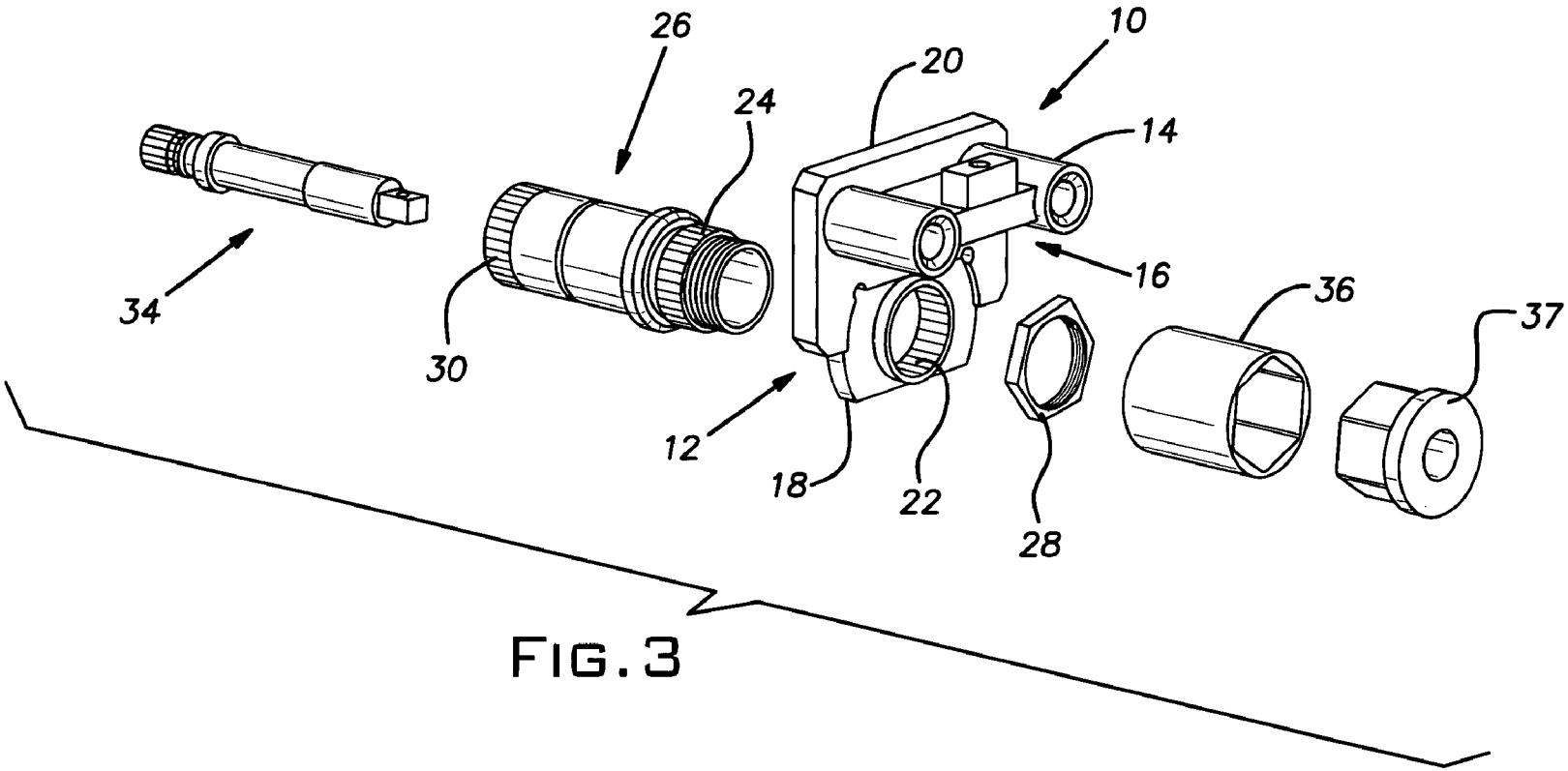
FIG. 3 is exploded perspective view of the torque reaction control jig of FIGS. 1–2, together with the spindle nut and portions of the nut runner.

In the following description, the various sides and surfaces of the alignment jig of the present invention are described as they are presented in the drawings. Accordingly, the use of the directional references (i.e., upper, lower, lateral side, etc.,) is only to be construed as they relate to the orientation of the jig in the drawings. Insofar as the jig is capable of use in various orientations, these directional references are not to be construed in a limiting fashion.

With reference to FIGS. 1–3, the torque reaction control jig 10 of the present invention includes a jig body 12, a pair of wheel stud receptacles or nests 14, and a barrier member 16. In the preferred and illustrated embodiment, the jig body 12 includes an adaptor body 18 that is affixed to an alignment body 20.

The adaptor body 18 has a generally rectangular peripheral shape, albeit with curved or arcuate lateral sides, and is partially received within a similarly shaped, downwardly facing recess formed in the alignment body 20. As such, an upper portion of the adaptor body 18 is received within the alignment body 20 while a lower portion of the adaptor body 18 projects or extends downwardly from the alignment body 20. Preferably, the adaptor body 18 is permanently affixed, such as by welding, to the alignment body 20.

Insofar as the adaptor body 18 and alignment body 20 are integrally attached to one another so as to define the jig body 12, it is clear that the jig body 12 could be formed as a single piece instead of being formed from separate pieces that are welded together. Such integration would be a natural evolution of the design for a high-volume production of the jig 10. However, the illustrated and currently preferred embodiment of the jig 10 is formed by affixing a commercially available adaptor body 18 to the alignment body 20 in the illustrated manner.

The adaptor body 18 defines a splined bore 22 that is adapted to receive a splined portion 24 of a shaft housing 26, as illustrated in FIG. 3. Due to the spline-connection between the adaptor body 20 and the shaft housing 26, the shaft housing 26 and the adaptor body 18 are connected to one another in a non-rotatable fashion. The distal end of the shaft housing 26 is threaded and receives a nut 28, which is disposed on a forward surface of the adaptor body 18 to secure the shaft housing 26 to the adaptor body 18. The proximal end of the shaft housing 26 also has a splined surface 30 that is secured to the host drive member or nut runner 32 in a non-rotatable fashion. As will be apparent from the following discussion, reaction torque, which would otherwise be experienced by the operator, is transmitted from the nut runner 32, via the shaft housing 26, to the jig 10.

A drive shaft 34 of the nut runner 32 extends through the shaft housing 26, the adaptor body 18, and the nut 28. A distal end of the drive shaft 34 is secured to a drive socket 36 disposed forwardly of the adaptor body 18. The opposite or proximal end of the drive shaft 34 is rotated by the nut runner 32 and, in turn, rotates the drive socket 36 and a spindle nut 37 received therein.

The adaptor body 18, nut 28, shaft housing 26 and drive shaft 34 described herein are known in the art and readily commercially available, and are sold as part of an adaptor assembly by Atlas Copco Tools AB of Stockholm, Sweden as ETP S9, Front part 150/200.

The alignment body 20 is solid and, with the exception of the recess that receives the adaptor body 18, has a generally rectangular peripheral shape. The stud nests 14, which serve as alignment members to insure that the jig 10 is properly aligned with the wheel studs 38, are secured to a front surface of the alignment body 20, and project forwardly therefrom. The stud nests 14 are cylindrical and identical to one another, and each define a central bore 14*a* for receipt of a wheel stud 38. A distal end of the stud nests 14 has an annular, beveled surface 14*b* surrounding an outer end of the central bore 14*a*. The beveled surface 14*b* assists in aligning and inserting the wheel stud 38 into the central bore.

The barrier member 16 is preferably integrally secured to the stud nests 14, and extends between and interconnects the stud nests 14. The barrier member 16 and stud nests 14 are permanently affixed, preferably by welding, to one another and to the front surface of the alignment body 20.

The barrier member 16 is preferably formed in an inverted T-shape, having a lower arm 16*a* that extends between the stud nests 14 and a leg 16*b* that extends upwardly from a central portion of the lower arm 16*a*. It is contemplated that, so long as the desired function (described hereinafter) is retained, the barrier member 16 could be formed in several alternative shapes without departing from the scope and spirit of the present invention.

With reference to FIG. 2, the jig 10 of the present invention is illustrated in use together with the nut runner 32, which preferably is a DC torque-limited or torque-controlled gun, such as is sold by Atlas Copco Tools AB as an ETP S9. Such DC torque-limited guns are controlled to apply a predefined torque to a nut, and therefore provide easily controlled, consistent, and repeatable results in a manufacturing environment. The nut runner receives electrical power and control signals, and provides feedback signals to a controller (not shown), via a cable 32*a*.

The nut runner 32 is suspended from an overhead support via a tether 40. The tether 40 is secured to a swivel mount 42 at a front end of the nut runner 32 and permits the nut runner 32 to be easily repositioned laterally and rotationally reoriented, as necessary.

In use, the jig 10 is positioned adjacent a support member or wheel 44, and the wheel studs 38 are aligned with and partially inserted into the jig stud nests 14. The spindle nut 37 is aligned with the axle 46 and received by the drive socket 36. The nut runner 32, which is disposed on a rear side of the jig 10, is operated to rotate the drive shaft 34 and, hence, the drive socket 36 and spindle nut 37. With the exception of lateral or horizontal movement toward the wheel 44, the shaft housing 26 and jig 10 remain stationary during rotation of the drive shaft 34, but are adapted to transmit reaction torque to the jig 10, via the spline connection described previously, and then to the wheel studs 38 as the spindle nut 37 bottoms out and tightens the wheel 44 to the axle 46.

As noted hereinbefore, the jig 10 of the present invention is specially adapted for use in tightening the spindle nut 37 to the vehicle axle 46 so as to secure the wheel 44 to the axle 46. Moreover, and with reference to FIGS. 4–5, the jig barrier member 16 insures that the jig 10 is properly aligned before any reaction torque is developed.

Figure 4:
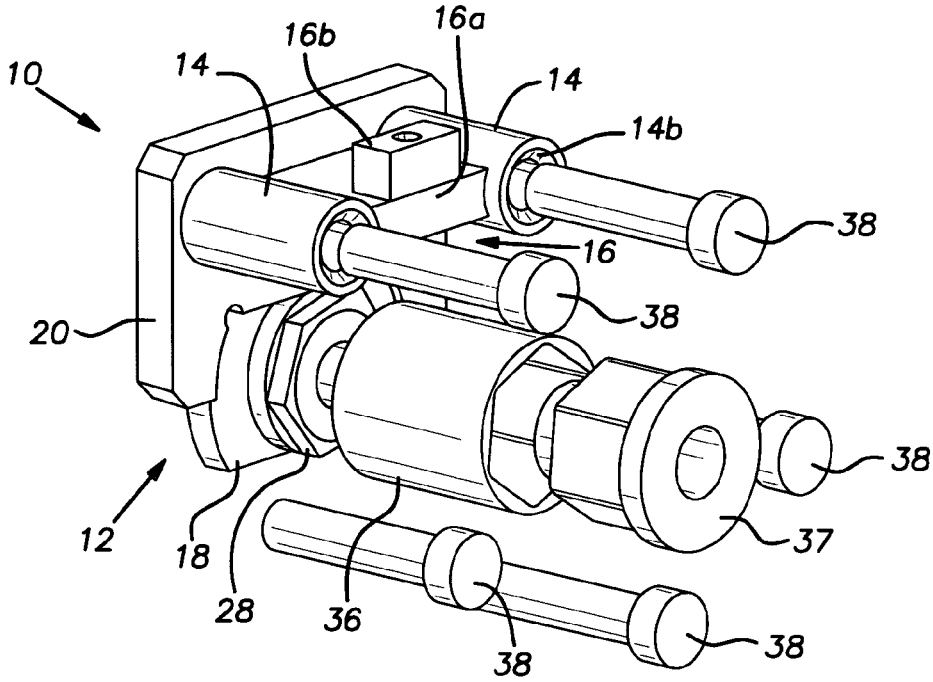
FIG. 4 schematically illustrates use of the jig of FIGS. 1–3 when properly aligned with the wheel studs; and, FIG. 5 schematically illustrates the jig of FIGS. 1–3 when not properly aligned with the wheel studs.

As shown in FIGS. 2 and 4, when the jig 10 is properly oriented, the stud nests 14 are aligned with the wheel studs 38 such that the wheel studs 38 are positioned for insertion into the bores 14*a* of the stud nests 14. Therefore, when the nut runner 32 is operated, the spindle nut 37 is threaded onto the axle 46, the jig 10 is pulled toward the wheel 44, and the wheel studs 38 are progressively inserted into the stud nests 14. When the spindle nut 37 bottoms or tightens the axle 46 to the wheel 44, reaction torque is transmitted through the jig 10 to the wheel studs 38 received in the stud nests 14. The transmission or transfer of reaction torque from the nut runner 32 to the wheel studs 38 is generally transparent to the operator.

In this regard it will be appreciated by those skilled in the art that, due to the standard arrangement of the wheel studs 38, in order to turn the spindle nut 37 onto the axle 46 with the drive socket 36, the wheel studs 38 must either be aligned with the stud nests 14, or else one wheel stud 38 will engage the barrier member.

Figure 5:
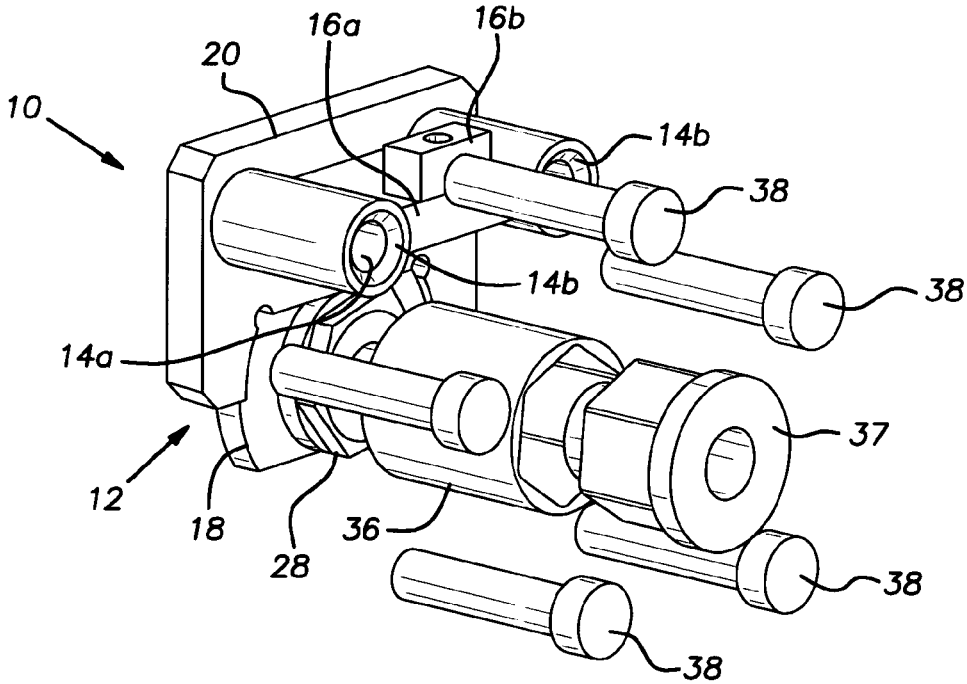

Accordingly, and as shown in FIG. 5, should the jig 10 be oriented relative to the wheel 44 such that the wheel studs 38 are out of alignment with the stud nests 14, threading of the spindle nut 37 onto the axle 46 will cause one of the wheel studs 38 to engage the barrier member 16. Engagement between the wheel stud 38 and the barrier member 16 prevents further progress of the jig 10 toward the wheel 44 and thereby prevents further threading of the spindle nut 37 onto the axle 46. Accordingly, the operator is alerted to the misalignment of the jig 10 prior to the development of reaction torque, and will be forced to properly align the jig 10 (i.e., to the position of FIG. 4) to further turn the spindle nut 37 onto the axle 46.

Although the preferred embodiment of the present invention has been described herein with specificity, it is considered clear that the invention is capable of numerous modifications, rearrangements, and substitutions of parts and, therefore is not to be limited to the preferred embodiment described herein. For example, while the jig of the present invention has been described herein as it is used in conjunction with an electric DC torque controlled nut runner, it is considered clear that the jig could be used with other drive devices, such as pneumatic nut runners, or the like. Accordingly, the present invention is only to be defined by the claims appended hereto.

What is claimed is:

1. A torque reaction control jig that is adapted to transfer reaction torque from a drive member to a support member upon threading of a nut onto a threaded member, said jig comprising:

a jig body, said jig body including an adaptor portion that is adapted to be secured to the drive member in a non-rotatable fashion;

an alignment member extending from the jig body, said alignment member being adapted to slidably receive a portion of said support member;

a barrier member secured to said jig body and serving to engage the support member should said alignment member be out of alignment with said support member, engagement between said barrier member and said support member preventing further tightening of the nut onto the threaded member; and, wherein said adaptor member includes a splined bore, said alignment member includes a pair of nests, said barrier member being integrally secured to the nests extending between and interconnecting the nests, the barrier member and the nests being permanently affixed to one another and to a front surface of the alignment body, the barrier member being formed in an inverted T-shape, having a lower arm extending between the nests and a leg extending upwardly from a central portion of the lower arm.

2. The torque reaction control jig according to claim 1, wherein said support member comprises a wheel and a series of wheel studs, said nut is a spindle nut, and said threaded member is an axle.

3. The torque reaction control jig according to claim 2, wherein said nests comprises a pair of cylindrical receptacles, and wherein said portion of said support member is a pair of adjacent wheel studs, each of said pair of adjacent wheel studs being slidingly received in an associated one of said cylindrical receptacles.

4. The torque reaction control jig according to claim 3, wherein said barrier member is in a position to engage an outer end of one of said wheel studs when said jig is out of alignment with said wheel.

5. In combination, a torque reaction control jig and a wheel, said torque reaction control jig being adapted to transfer reaction torque from a drive member to said wheel upon threading of a spindle nut onto an axle, said combination comprising:

a plurality of wheel studs extending from said wheel;

a jig body, said jig body including an adaptor portion that is adapted to be secured to the drive member in a non-rotatable fashion;

an alignment member extending from the jig body, said alignment member comprising a pair of stud nests that are each adapted to slidably receive an associated one of said plurality of wheel studs; and, a barrier member secured to said jig body;

wherein said jig is movable relative to the wheel between an aligned position, in which said stud nests are generally coaxial with said associated wheel studs, and a misaligned position in which said stud nests are not coaxial with associated wheel studs, and wherein said barrier member engages one of the wheel studs when said jig is in the misaligned position and thereby limits threading of the spindle nut onto the axle.

6. The combination according to claim 5, wherein said stud nests are generally cylindrical, and include a beveled annular surface that serves to guide the wheel stud into a central bore defined by said stud nest.

7. The combination according to claim 6, wherein said barrier member is disposed between said stud nests.

8. A method for tightening a spindle nut on an axle to secure a wheel to said axle, said wheel having a plurality of wheel studs extending therefrom, comprising the steps of:

providing a torque reaction control jig between a drive member and a drive socket, said drive socket being rotatably driven by said drive member, said jig comprising:

a jig body, an alignment member that is adapted to receive at least two of said wheel studs when said jig is properly aligned with said wheel studs; and, a barrier member that is adapted to engage one of said wheel studs when said jig is improperly aligned with said wheel studs;

aligning said wheel studs with said jig such that said wheel studs are positioned for receipt by said alignment member;

placing a spindle nut on said drive socket and engaging said spindle nut with said axle;

operating said drive member so as to rotate said drive socket and spindle nut to turn said spindle nut onto said axle while drawing said jig toward said wheel and thereby receiving said wheel studs by said alignment member.

9. The method according to claim 8, comprising the further step of:

transferring reaction torque from the drive member, through the jig, and to the wheel when the spindle nut tightens the wheel to the axle.

* * * * *